US006175083B1

(12) United States Patent
Palmer et al.

(10) Patent No.: US 6,175,083 B1
(45) Date of Patent: Jan. 16, 2001

(54) SEALING A LEAD FROM A CONFINED CAVITY OF AN APPARATUS

(75) Inventors: Clarence K. Palmer, Rockford; Kenneth M. Roat, Peoria; Thomas R. Springer, Pekin, all of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/209,943

(22) Filed: Dec. 11, 1998

(51) Int. Cl.[7] ..... H01B 17/26

(52) U.S. Cl. ..... 174/152 G; 174/153 G; 174/65 G; 174/151; 174/167

(58) Field of Search ..... 174/152 G, 153 G, 174/65 G, 152 R, 151, 167; 16/2.1, 2.2, 2.3, 2.4, 2.5; 248/56

(56) References Cited

U.S. PATENT DOCUMENTS

| | | | | |
|---|---|---|---|---|
| 4,122,433 | * | 10/1978 | McNeel | 340/17 |
| 4,226,432 | * | 10/1980 | Nakazimo | 277/212 F |
| 4,567,544 | * | 1/1986 | Ronemus et al. | 361/399 |
| 4,701,999 | | 10/1987 | Palmer | 437/211 |
| 5,173,053 | | 12/1992 | Swanson et al. | 439/27 |
| 5,226,220 | | 7/1993 | Gevas et al. | 29/605 |
| 5,504,973 | * | 4/1996 | Kameyama | 16/2 |
| 5,533,249 | | 7/1996 | Wakeman | 29/605 |
| 5,557,073 | * | 9/1996 | Truesdale, Jr. | 174/151 |
| 5,589,808 | | 12/1996 | Clark et al. | 336/92 |
| 5,710,535 | | 1/1998 | Goloff | 336/192 |
| 5,920,035 | * | 7/1999 | Haney et al. | 174/65 SS |
| 6,087,590 | * | 7/2000 | Meinherz et al. | 174/99 R |

FOREIGN PATENT DOCUMENTS

| | | | |
|---|---|---|---|
| 0662696A1 | 12/1995 | (EP) | H01F/7/06 |

* cited by examiner

*Primary Examiner*—Kristine Kincaid
*Assistant Examiner*—W. David Walkenhorst
(74) *Attorney, Agent, or Firm*—J. W. Burrows

(57) ABSTRACT

A sealing mechanism is provided to seal a lead from a closed cavity of an apparatus. The sealing mechanism includes a mounting portion sealingly connected to the apparatus, a cap member having a recess defined therein with an elastomeric grommet compressively disposed in the recess. The elastomeric grommet has a passageway defined therethrough for the lead from the closed cavity to past through. The compressive forces induced into the elastomeric grommet applies a compressive force on the lead to provide a seal. The cap member is sealingly connected to the mounting portion. Consequently, the closed cavity in the apparatus is effectively sealed from the atmosphere and contaminants cannot enter the closed cavity and create premature failure of the component therein, such as, for example, an electrical coil.

10 Claims, 2 Drawing Sheets

SEALING A LEAD FROM A CONFINED CAVITY OF AN APPARATUS

TECHNICAL FIELD

This invention relates generally to an arrangement for sealing a lead from a confined cavity of an apparatus and more particularly to an externally mounted mechanical sealing arrangement.

BACKGROUND ART

Various attempts have been set forth to seal lead wires or pins extending from a coil that is encapsulated within an overmolded plastic material. In some of these attempts, a cavity is formed within the overmolded material and the lead wires or pins from the coil extends into the cavity and a rubber grommet is disposed within the cavity. The lead wires extend through holes within the grommet and are sealed by a compressive force exerted on the outer circumference of the grommet. Many times, in these attempts, it is difficult to mold the plastic material around the leads extending therethrough. Many other arrangements are known for connecting leads to coils having overmolded material disposed around the coil. In these other arrangements, the leads that extend from the coil through the overmolded material may not be totally sealed from the outside atmosphere when being subjected to varying temperature. It is well known that when a coil is produced small voids are present after the winding is placed on the bobbin and the overmolded material is injected around the coil. During an increase in temperature, the pressure of the air within these voids expands thus producing an increase in pressure therein which, if not properly sealed, escapes around the leads that passes through the overmolded material. Likewise, as the temperature decreases, a pressure less than atmospheric is created within the voids. Consequently, if the leads are not properly sealed, air is drawn into the voids from the outside atmosphere. If the coil is being used in an environment containing contaminants, the contaminants are drawn into the voids and cause premature failure of the coil. Therefore, it is desirable to provide a positive seal around the leads so that contaminants cannot be drawn into the coil or sealed cavity. Likewise, it is desirable to provide such a seal arrangement to seal around other types of leads to protect sensitive components disposed in an otherwise sealed cavity from outside contaminants.

The present invention is directed to overcoming one or more of the problems as set forth above.

DISCLOSURE OF THE INVENTION

In one aspect of the present invention a sealing mechanism is provided and adapted for sealing a lead having a predetermined cross-sectional shape and size extending from a closed cavity of an apparatus. The sealing mechanism includes a mounting portion having a face portion with the lead extending from the face portion and being sealingly connected to the apparatus. A cap member is also provided and has a closed end portion with a passage defined through the closed end and an open end portion having a face surface. A recess is defined in the cap member and has a predetermined cross sectional shape and size and extends inwardly from the face portion. The open end portion of the cap member is sealingly connected to the mounting portion generally adjacent the face portion of the mounting portion. The mounting portion also includes an elastomeric grommet having a passageway of a predetermined shape generally the same as the shape of the lead and a predetermined size substantially the same as or smaller than the size of the cross-sectional size of the lead. The elastomeric grommet has at least in part a predetermined cross-sectional shape generally the same as the shape of the recess in the cap member and a predetermined size that is larger than the size of the recess of the cap member. The elastomeric grommet is disposed within the recess of the cap member with the lead extending through the passageway of the grommet and the passageway in the closed end portion of the cap member.

BEST MODE FOR CARRYING OUT THE INVENTION

Figure 1:
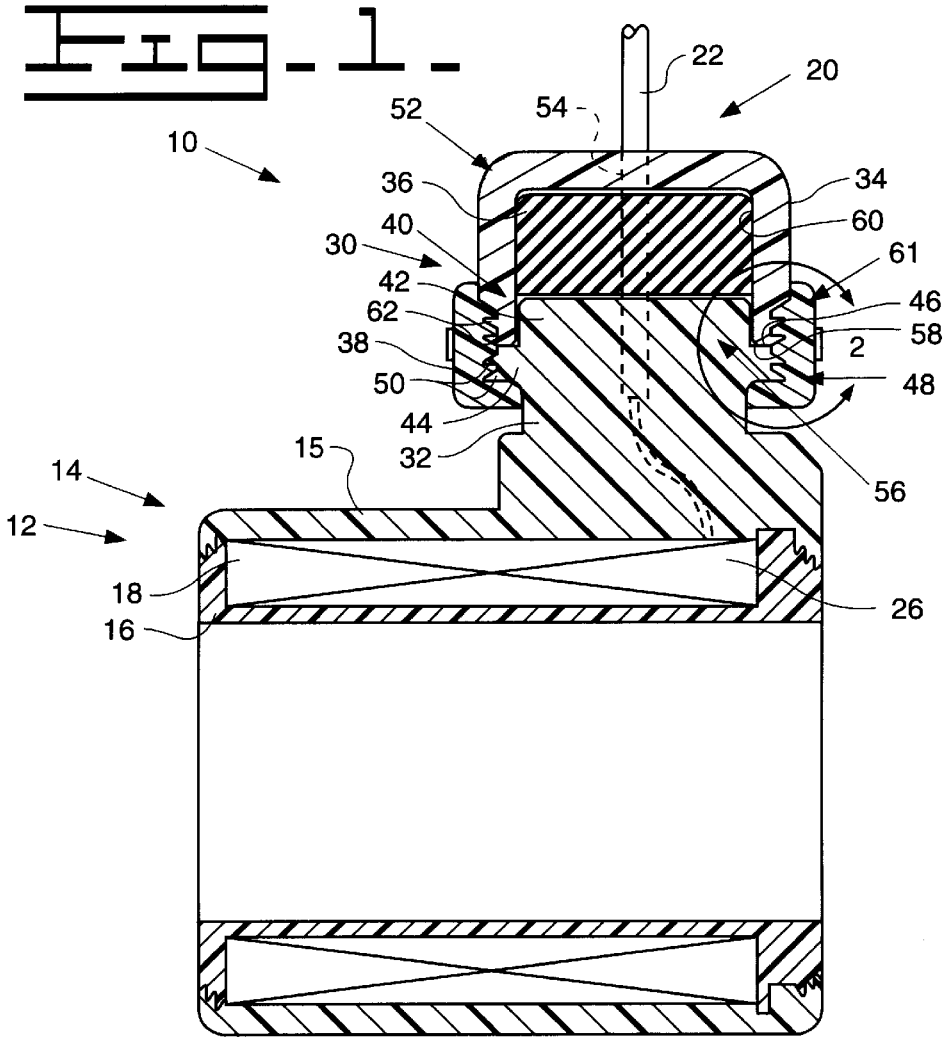
FIG. 1 is a diagrammatic representation of a coil assembly incorporating an embodiment of the present invention.
Figure 2:
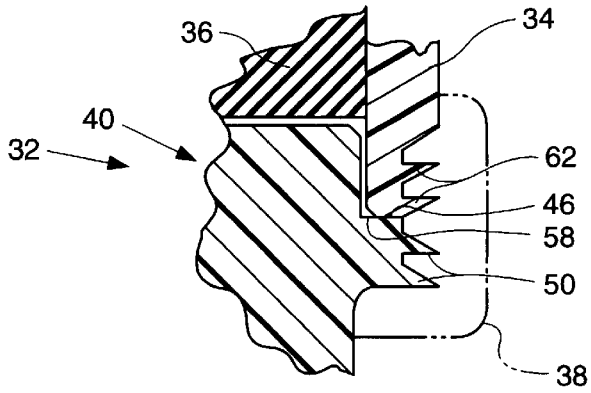
FIG. 2 is a partial sectional view illustrating a portion of the coil assembly prior to having a collar disposed therearound.
Figure 3:
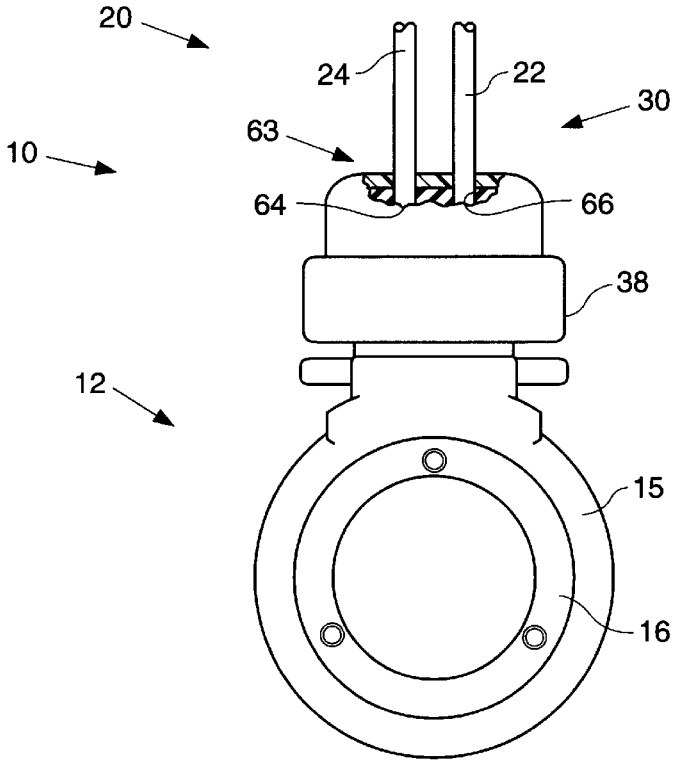
FIG. 3 is an end view of the coil assembly of FIG. 1.

Referring to the drawings and more particularly to FIGS. 1–3, an apparatus 10, such as a coil assembly 12 is illustrated. The coil assembly 12 includes a coil 14 that is enclosed by an overmolded material 15 to protect the coil from contamination. The coil 14 is made up of a bobbin 16 and windings 18 in a well known manner. A lead 20 is connected to and extends from the windings 18 through the overmolded material. The portion of the lead 20 extending from and generally adjacent to the overmolded material 15 has a predetermined cross-sectional shape and size.

In the subject embodiment, the lead 20 includes first and second flexible wires 22, 24 having an insulating material disposed around the wires in a well known manner. It is also known to fill any space between the wire and the insulating material with a substance, such as silicone, in order to ensure that air cannot pass therethrough. The coil 14 is located in a closed cavity 26 formed by the overmolded material 15 and the bobbin 16.

It is recognized that the apparatus 10 could be many things other than a coil assembly 12. For example, the apparatus 10 could be a transmission housing, a sensor housing, or any other types of structures having a closed cavity 26 with a lead 20 extending therefrom through the wall of the apparatus 10.

A sealing mechanism 30 is integrally connected to the apparatus 10. In the preferred embodiment, the sealing mechanism 30 includes a mounting portion 32, a cap member 34, an elastomeric grommet 36 and a collar mechanism 38. The mounting portion 32 is sealingly connected to the apparatus 10 and includes a face portion 40. The face portion 40 has an extension 42 of a predetermined cross-sectional shape and size and a larger shoulder portion 44 having a locating face 46. A first melt flange arrangement 48 is disposed on the face portion 40 generally adjacent the locating face 46. The first melt flange arrangement 48 has a plurality of melt flanges 50 located generally adjacent one another. In the subject embodiment there are two melt flanges 50.

The cap member 34 has a closed end portion 52 with a passage 54 defined therethrough. An open end portion 56 is also part of the cap member 34 and has a face surface 58 with a recess 60 defined therein and extending from the face surface 58 inward towards the closed end portion 52. The cap member 34 is sealingly connected to the mounting portion 32.

The recess 60 has a predetermined cross-sectional shape and size. The predetermined shape of the subject embodiment is circular. When assembled, the face surface 58 is in intimate contact with the locating face 46 of the shoulder portion 44. The predetermined shape of the recess 60 is generally the same as the predetermined shape of the extension 42 of the face portion 40 and the predetermined size of the recess 60 is slightly larger than the predetermined size of the extension 42 so that the cap member 34 fits over the extension 42.

The cap member 34 also has a second melt flange arrangement 61 disposed thereabout on the open end portion 56 adjacent the face surface 58. The second melt flange arrangement 61 has a plurality of melt flanges 62 located adjacent one another. In the subject embodiment, the second melt flange arrangement 61 has two melt flanges 62.

The elastomeric grommet 36 has a passageway 63 defined therethrough. The passageway 63 has a predetermined cross-sectional shape and size. The predetermined shape is generally the same as the predetermined shape of the lead 20 and the predetermined size is the same or smaller than the size of the lead 20. In the subject embodiment, the passageway 63 is in the form of two passages 64, 66. Each of the passages 64, 66 has a predetermined cross-sectional shape the same as the shape of the flexible wires 22, 24 and each has a size the same as or smaller than the size of the flexible wires 22, 24. The elastomeric grommet 36 has a thickness that is less than the space between the bottom of the recess 60 of the assembled cap member 34 and the face portion 40 of the mounting portion 32.

The collar mechanism 38 is disposed about and encircles the first and second melt flange arrangements 48, 61 to sealingly secure the cap member 34 to the mounting portion 32. The collar mechanism 38 is molded in place by any known hot molding process. In the subject embodiment, the collar mechanism 38 is molded in place by an injection molding process. During the molding process, the heat used in the molding process melts the ends of the melts flanges 50, 62 resulting in the material from the collar mechanism 38 bonding with the material from the respective melt flange arrangements 48, 61 to form a airtight seal therebetween.

Referring more specifically to FIG. 2, an enlarged partial section better illustrates the respective melt flanges 50, 62 prior to the collar mechanism 38 being molded thereabout.

Figure 4:
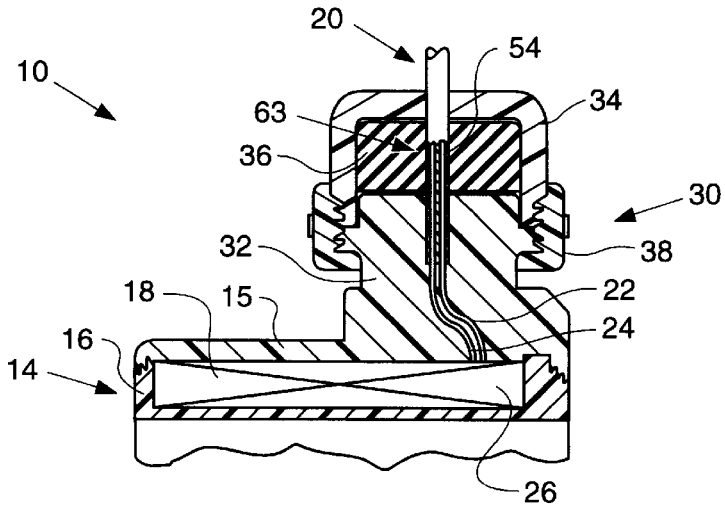
FIG. 4 is a diagrammatic representation of another embodiment of a coil assembly incorporating the present invention.

Referring to FIG. 4, another embodiment of the apparatus 10 is illustrated. In the embodiment of FIG. 4, like elements have like element numbers. The only difference in FIG. 4 as compared to FIGS. 1–3 is that there is only one lead 20 extending from the closed cavity 26 through the overmolded material 15. In the embodiment of FIG. 4, two different wires 22, 24 are routed through the one lead 20 and any spaces are filled with silicone. It is recognized that the lead could be a tube or other device communicating an air pressure or a fluid pressure from the closed cavity to a control module.

It is recognized that various embodiment can be used without departing from the essence of the subject invention. For example, for the broadest aspect of the invention, the collar mechanism 38 could be omitted and the cap member 34 swaged to the mounting portion 32 with an elastomeric seal, such as an o-ring disposed between the cap member 34 and the outer periphery of the mounting portion 32. Additionally, either of the respective melt flange arrangements 48/61 could consist of one or more melt flanges 50/62. Likewise, even though in the preferred embodiment the overmolded material 15, the mounting portion 32, and the cap member 34 are made of a thermo-plastic material, other types of materials could be used. For example, the noted elements could be made of a metal, a thermo-plastic material, a thermo-set material or any combination thereof.

Industrial Applicability

The sealing mechanism 30 of the subject invention is effective to provide an air tight seal for the lead 20 extending from the closed cavity 26 of the apparatus 10. Since the mounting portion 32 is integrally formed with the apparatus 10, the mounting portion 32 is sealed with respect to the apparatus 10. Likewise, except for the lead 20 extending through the closed cavity 26, the closed cavity is protected from the environment.

During assembly, the respective wires 22, 24 are directed through the respective first and second passages 64, 66 of the elastomeric grommet 36. The wires 22, 24 are then passed through the passage 54 in the cap member 34 and the cap member 34 is urged over the elastomeric grommet 36. As the elastomeric grommet 36 enters the recess 60 of the cap member 34, the material of the elastomeric grommet 36 is compressed due to the size of the recess being smaller than the size of the elastomeric grommet 36. The compression of the material in the elastomeric grommet 36 results in a compressive force being applied to each of the flexible wires 22, 24. The compressive force being applied to the wires 22, 24 provides an effective seal so that contaminants cannot pass by the sealed portion of the wires 22, 24.

Once the face surface 58 of the cap member 34 contacts the locating face 46 of the shoulder portion 44, the collar mechanism 38 can be injection molded into place. As noted above, during the injection molding of the collar mechanism 38, the ends of the respective melt flanges 50, 62 melt and bond with the material of the collar mechanism 38 to provide a seal therebetween.

The outer diameter of the respective wires 22, 24 are sealed by the compressive forces from the material of the elastomeric grommet 36. The outer periphery of the elastomeric grommet 36 is sealed by pressure contact with the recess 60 of the cap member 34. The path between the face portion 40 of the mounting portion 32 and the one side of the elastomeric grommet 36 is sealed by the collar mechanism 38 being molded in place. The wires 22, 24 leading to the coil 14 are now effectively sealed from the atmosphere and contaminants are prohibited from entering the closed cavity 26 where the coil 14 is located.

During operation of the coil assembly 12, the heat produced causes the air in the voids of the windings 18 to increase. This increase in pressure is effectively sealed so that it cannot escape. Likewise, if the pressure within the voids of the windings 18 reduces below atmospheric pressure, the sealing arrangement 30 is effective to inhibit the passage of air into the closed cavity 26. Consequently, contaminants are not permitted to ingress into the closed cavity 26 and cause premature failure of the coil 14.

In view of the foregoing, it is readily apparent that the subject sealing mechanism 30 provides a seal around lead 20 to prohibit contaminants from reaching the closed cavity of an apparatus, such as a coil assembly. By stopping the ingression of contaminants, the life of the coil assembly is increased.

Other aspects, objects and advantages of this invention can be obtained from a study of the drawings, the disclosure and the appended claims.

We claim:

1. A sealing mechanism adapted for sealing a lead extending from a closed cavity of an apparatus, the lead has a predetermined cross-sectional shape and size comprising:

a mounting portion having a face portion with the lead extending from the face portion and being sealingly connected to the apparatus;

a cap member having a closed end portion with a passage defined through the closed end and an open end portion having a face surface with a recess having a predetermined cross sectional shape and size defined in the cap member, the recess extends inwardly from the face portion, the open end portion of the cap member being sealingly connected to the mounting portion generally adjacent the face portion of the mounting portion;

an elastomeric grommet having a passageway of a predetermined cross-sectional shape generally the same as the shape of the lead and a predetermined size substantially the same as or smaller than the size of the lead and the elastomeric grommet having at least in part a predetermined cross-sectional shape generally the same as the shape of the recess in the cap member and a predetermined size that is larger than the size of the recess of the cap member, the elastomeric grommet being disposed within the recess of the cap member with the lead extending through the passageway of the grommet and the passage in the closed end portion of the cap member; and a collar mechanism sealingly disposed about the face portion of the mounting portion and the open end portion of the cap member.

2. The sealing mechanism of claim 1 wherein the mounting portion has a first melt flange arrangement disposed thereabout and located generally adjacent the face portion and the end face portion of the cap member has a second melt flange arrangement disposed thereabout generally adjacent the face surface, the collar mechanism being hot molded about the first and second melt flange arrangements so that portions of the respective melt flanges melt and bond with the collar mechanism during the molding process.

3. The sealing mechanism of claim 2 wherein the lead is a flexible lead wire having an insulating cover disposed thereabout.

4. The sealing mechanism of claim 3 wherein the first melt flange arrangement includes a plurality of melt flanges located generally adjacent one another and the second melt flange arrangement includes a plurality of melt flanges located generally adjacent one another and the collar is molded by an injection molding process.

5. The sealing mechanism of claim 4 wherein the lead includes a second flexible wire having an insulating cover disposed thereabout.

6. The sealing mechanism of claim 4 in combination with a coil assembly having a coil disposed within an overmolded material and the mounting portion being integrally formed with the overmolded material and the lead being connected with the coil.

7. The sealing mechanism of claim 6 wherein the overmolded material and the mounting portion are made from a thermo-plastic material.

8. The sealing mechanism of claim 7 wherein the cross-sectional shape of the recess and the elastomeric grommet is circular in shape.

9. The sealing mechanism of claim 8 wherein the elastomeric grommet has a predetermined thickness that is less than a space defined between the face portion of the mounting portion and the bottom of the recess in the cap member.

10. The sealing mechanism of claim 9 wherein the face portion of the mounting portion has a first cross-sectional size that is less than the cross-sectional size of the recess and a larger shoulder that mates with the face surface of the open end portion of the cap member.

* * * * *